US005368011A

United States Patent [19]

Bodner

[11] Patent Number: 5,368,011

[45] Date of Patent: Nov. 29, 1994

[54] APPLIANCE COMBUSTION CHAMBER

[75] Inventor: Timothy J. Bodner, Ft. Wayne, Ind.

[73] Assignee: Rheem Manufacturing Company, a Delaware Corp., New York, N.Y.

[21] Appl. No.: 75,122

[22] Filed: Jun. 9, 1993

[51] Int. Cl.[5] ..... F24H 3/00

[52] U.S. Cl. ..... 126/116 R; 126/110 R; 431/353

[58] Field of Search ..... 126/110 R, 110 B, 116 R; 431/352, 353

[56] References Cited

U.S. PATENT DOCUMENTS

| | | | |
|---|---|---|---|
| 2,579,047 | 12/1951 | Luty | 126/110 |
| 3,448,736 | 6/1969 | Shenberger | 126/116 |
| 3,470,864 | 10/1969 | Emmert | 126/110 |
| 3,500,814 | 3/1970 | De Lancey | 126/110 |
| 3,557,772 | 1/1971 | Kofink | 126/110 |
| 3,557,773 | 1/1971 | Ray | 126/144 |
| 3,580,237 | 5/1971 | Barsby | 126/110 |
| 3,951,584 | 4/1976 | Thekdi | 431/352 |
| 4,203,415 | 5/1980 | Gruber et al. | 126/110 |
| 4,557,249 | 12/1985 | Sweedyk | 126/110 |
| 4,561,421 | 12/1985 | Kwang et al. | 126/110 |
| 4,718,401 | 1/1988 | De Lancey | 126/110 |
| 4,729,328 | 3/1988 | Shellenberger | 110/193 |
| 4,905,661 | 3/1990 | Wilson, Jr. | 126/99 |
| 4,960,102 | 10/1990 | Shellenberger | 126/110 |
| 4,974,579 | 12/1990 | Shellenberger et al. | 126/110 |
| 5,042,453 | 8/1991 | Shellenberger | 126/110 |
| 5,277,578 | 1/1994 | Ratnahi et al. | 431/352 |

*Primary Examiner*—Carroll B. Dority
*Attorney, Agent, or Firm*—Johnson & Wortley

[57] ABSTRACT

A fuel-air combustion chamber with improved mounting and thermal distribution features. The combustion chamber is formed with a flange adapted for receiving a plurality of retainer rings therearound for direct securement of the flange to a burner mounting plate adjacent a fuel-air nozzle for generating heat within the combustion chamber. The combustion chamber is also temporarily supported within the furnace housing by a combustible support leg affixed thereto. In this manner, the combustion chamber is supported during shipping and handling by a support leg which is automatically disintegrated during use of the combustion chamber.

43 Claims, 3 Drawing Sheets

APPLIANCE COMBUSTION CHAMBER

BACKGROUND OF THE INVENTION

1. Field of the Invention

The present invention relates to furnaces of the type having combustion chambers for ignition of a fuel-air mixture and, in particular, to an oil fired heating furnace combustion chamber and mounting method therefor.

2. History

Heating furnaces typically include a combustion chamber for the burning of a fuel and air mixture therein, and a heat exchanger for efficient transfer of heat therefrom. The heat exchanger is generally designed to receive the passage of air returning from the space conditioned by the furnace (comfort air) and permit the air to pass over a region thereof in close proximity to the combustion chamber. In a fuel fired, forced air furnace, the combustion chamber is typically disposed within the heat exchanger. The heat from the combustion occurring therein, as well as the gaseous combustion products thereof, flow through a primary and, usually, a secondary heat exchanger to heat the comfort air flowing thereover. As the comfort air externally traverses this heat exchanger, combustion heat is transferred to the comfort air from the outer surface of the heat exchanger. The heated comfort air is then discharged from the furnace through ducts, or the like, for injection into the space from which it was originally withdrawn. This recirculation of air from and into a conditioned space is widely accepted as an efficient means for elevating and controlling the temperature therein.

The combustion chamber/heat exchanger assemblies for furnaces of the type described above are required to efficiently simultaneously perform two functions in an efficient manner. First, the combustion chamber must provide for essentially complete combustion of the fuel-air mixture received thereby. Secondly, the heat exchanger must also provide for efficient combustion heat transfer to the comfort air flowing through the furnace.

The genesis of the heat in a fuel-fired, forced air furnace is, of course, found in the combustion chamber where the fuel-air mixture is burned. It is therefore necessary for the combustion chamber to provide mechanical stability and functional efficiency during operation. The durability and reliability of conventional furnaces require that the combustion chamber be designed to effectively handle the requisite thermal distribution while presenting itself in a configuration that maximizes operational efficiency with a minimum of maintenance. At the same time, it is necessary that the combustion chamber be configured and aligned to promote stable combustion in a reliable fashion consistent with initial design parameters. For this to occur, the combustion chamber must be designed for maximum mechanical stability in shipping and handling and maximum thermal distribution in operation.

A variety of combustion chamber designs have found acceptance in prior art furnaces. Many of these designs are shown in a number of issued U.S. patents dating back to the late 1960's. For example, U.S. Pat. No. 3,470,864 entitled Combustion Chamber illustrates a generally cylindrical combustion chamber for an oil furnace in which an axially directed primary flame and combustion air are distributed radially and circumferentially through a series of circumferentially and axially spaced holes in the cylindrical combustion chamber wall. A pair of legs integrally formed of the ceramic material used to form the combustion chamber extends outwardly therefrom and engages a target plate forming an end wall of the heat exchanger. This pair of legs prevents the chamber from rotating and properly spaces the chamber from the target plate. The ends of the combustion chamber are supported by arcuate spring clips having outwardly bent ends. A number of specific design aspects have thus been considered relative to the combustion chamber and its assembly within the furnace.

Other patents illustrating prior art heat exchangers with cylindrical combustion chambers and/or combustion flame diffusers are shown in U.S. Pat. No. 4,203,415 entitled Heat Exchanger, U.S. Pat. No. 4,557,249 entitled Compact High Efficiency Furnace, and U.S. Pat. No. 4,718,401 entitled Hot Air Furnace. In the latter patent, the combustion chamber is constructed with an array of fins and includes a generally cylindrical, open ended diffuser preferably constructed of ceramic, or the like, and centered substantially coincident with a central axes of the burner for substantially enveloping a burning flame discharged therein. These specific combustion chamber configurations illustrate the wide variety of structural and functional parameters imposed upon combustion chamber assemblies. Of primary significance is, of course, the diffusion of the flame discharged within the combustion chamber and the thermal distribution of the heat generated thereby. Tantamount in the design, however, is also the mounting of the combustion chamber, the structural rigidity thereof, and the functional stability afforded by the design in operation.

As seen from the prior art references cited above, a variety of round and slotted openings have been used in prior art combustion chambers. A variety of combustion chamber mounting techniques have also been used. It is well known that the structural integrity of the combustion chamber relative to the remaining furnace necessitates a secure mounting configuration therein. Likewise the above referenced shape and size of the apertures as well as the spacing of the apertures in the combustion chamber or firebox necessitate long term structural and functional considerations.

It is necessary in the design of effective fuel fired, forced air furnaces for the combustion chamber to manifest efficient heat transfer and a stable structural configuration. For example, many conventional furnaces incorporate slotted apertures formed in elongate combustion chambers which are positioned within metal cages, and secured to adjacent panel walls of the combustion chamber assembly. Over the years, certain problems have been identified with such prior art designs. These problems include the inefficient circulation of combustion gases through the slots or apertures of the combustion chamber, the mechanical integrity of the combustion chamber material particularly around the slots or apertures therein and the stress, strain cracks that are often manifested therein. Additionally, access to the combustion chamber is often restricted due to its mounting configuration. This restricted access interferes with efficient repair and maintenance of the furnace as a whole.

Other considerations in combustion chamber design include the spacing of the opening in, through and around the combustion chamber and the basic thermal distribution aspects that are inherent in combustion chamber operation. Another equally serious problem, is the securement of the combustion chamber itself to a wall of the furnace housing. It is common for a combustion chamber formed of ceramic to be mechanically secured within a cage disposed within a heat exchanger in the furnace through the use of mechanical fasteners. Generally the cage extends rearwardly from a burner plate and captures the combustion chamber longitudinally thereagainst. A separate, permanent securement leg is often utilized to further stabilize the elongate combustion chamber relative to the burner plate against which it is initially secured. The support leg may, however, also interfere with certain gas flow patterns generated by the combustion chamber. A more serious problem is the position of the combustion chamber itself. Since it is often secured to a furnace panel wall by a metal cage and/or metal fasteners that extend along the elongate sides of the combustion chamber, any shrinkage of the ceramic material through normal use has been shown to cause a degree of separation of said combustion chamber from said panel wall. Any resulting separation is usually a deviation from initial design parameters and may permit a recirculating flow of combustion gases therearound. The recirculation of combustion gases back to a region within the combustion chamber may then result in less efficient combustion as well as related hot spots and functional inefficiencies due to the recirculation pattern of the hot gases.

It would be an advantage to overcome the problems of the prior art by providing a combustion chamber which may be mechanically secured within a furnace in a manner facilitating stability and reliability during operation as well as ease in accessibility to facilitate maintenance and repair. It would likewise be an advantage to provide a combustion chamber which also enhances the flow of combustion products therethrough and therearound for improving efficiency of the furnace. The present invention provides such a combustion chamber by utilizing a mounting collar which captures the combustion chamber at a first end adjacent the burner plate to which it is attached. The combustion chamber is also formed with a plurality of round holes formed in the side walls in a select pattern maximizing thermal distribution for particular applications and the circulation of combustion products outwardly therefrom. A mounting leg formed of combustible material is also secured to a second, opposite end of the combustion chamber for stabilization thereof during shipping and handling and disintegration during initial operation.

SUMMARY OF THE INVENTION

The present invention relates to an improved combustion chamber assembly for a fuel-air furnace. More particularly, one aspect of the present invention includes a fuel-air furnace combustion chamber of the type secured within a furnace housing adapted for the combustion of fuel and air therein. The combustion chamber is directly mounted to a burner mounting plate comprising a portion of a heat exchanger and secured thereto in flow communication with a fuel-air injection port. The burner mounting plate is then secured to a panel of the furnace which facilitates direct access to the combustion chamber and heat exchanger for maintenance and repair. The combustion chamber is secured to the burner mounting plate by a mounting means configured to engage a frontal section of the combustion chamber and secure said frontal section directly to the burner plate against which it is positioned. This direct securement of the frontal section of the combustion chamber to the burner mounting plate presents a sealed configuration thereacross which maximizes the stability and reliability thereof.

In another aspect, the above described mounting means comprises a mounting collar for securing the frontal section of the combustion chamber directly to the burner mounting plate. The mounting collar engages a flange on the end of the combustion chamber in a circumferential relationship therewith. Attachment means are provided in association with the collar for securing it directly to the burner mounting plate wherein the combustion chamber may be flushly mounted thereagainst in flow communication therewith a fuel-air injected mixture therein.

In another aspect, the above described mounting means comprises multiple retainer ring sections for securing the frontal section of the combustion chamber directly to the burner mounting plate. The retainer ring sections engage a flange on an end of the combustion chamber in a circumferential relationship therewith. Attachment means are provided in association with the retainer ring sections for securing them directly to the burner mounting plate wherein the combustion chamber may be mounted flush thereagainst in flow communication with a fuel-air mixture injected therein.

In another aspect, the above described invention includes a combustion chamber formed with a plurality of circular apertures disposed in a select array about the body of the combustion chamber. The combustion chamber is preferably formed of a ceramic material, such as alumina silica or the like. In one embodiment, an attachment collar comprising a metal band having a generally L-shaped cross section with an arcuate, longitudinal formation, is adapted for matingly engaging the flange of the combustion chamber. In another embodiment, retainer ring sections comprising a metal band having a generally L-shaped cross section with an arcuate, longitudinal formation, are adapted for matingly engaging the flange of the combustion chamber. In yet another embodiment, the combustion chamber flange also includes a plurality of notches adapted for receiving fastening members therethrough for direct engagement with the burner mounting plate.

In yet another aspect, the present invention includes the above described combustion chamber having at least one assembly support leg formed of combustible material. The support leg is positioned to secure the combustion chamber within the furnace housing during handling and shipment. With the support leg being formed of combustible material, such as cardboard, it is adapted to disintegrate during operation of the combustion chamber. In this manner, the support leg is effectively removed along with all impediments to the flow of the products of combustion and thermal distribution around the combustion chamber. Since efficiency in the operation of the combustion chamber depends on effective thermal distribution and free circulation of gases therearound, the removal of the support leg further enhances the efficiency of the combustion chamber operation.

In yet a further aspect, the present invention includes a method of mounting a combustion chamber within a fuel-air furnace comprising the steps of forming the combustion chamber with a flange and securing the flange to a burner mounting plate which forms part of the heat exchanger. The burner mounting plate is provided with an opening for a fuel-air nozzle and the combustion chamber is mounted such that its central axis is substantially coincident with a central axis of the fuel-air nozzle. In one aspect of this particular method, a collar, adapted for being received about the flange of the combustion chamber, is secured therearound and mounted directly to the burner mounting plate for securing the combustion chamber thereagainst in a sealed relationship therewith. In another aspect of this particular method, retaining ring sections, adapted for being received about the flange of the combustion chamber, are secured therearound and mounted directly to the burner mounting plate for securing the combustion chamber thereagainst in a sealed relationship therewith. In yet another aspect of this particular method, the combustion chamber is formed with a combustible support leg that is utilized for stabilizing the combustion chamber during shipping and handling.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
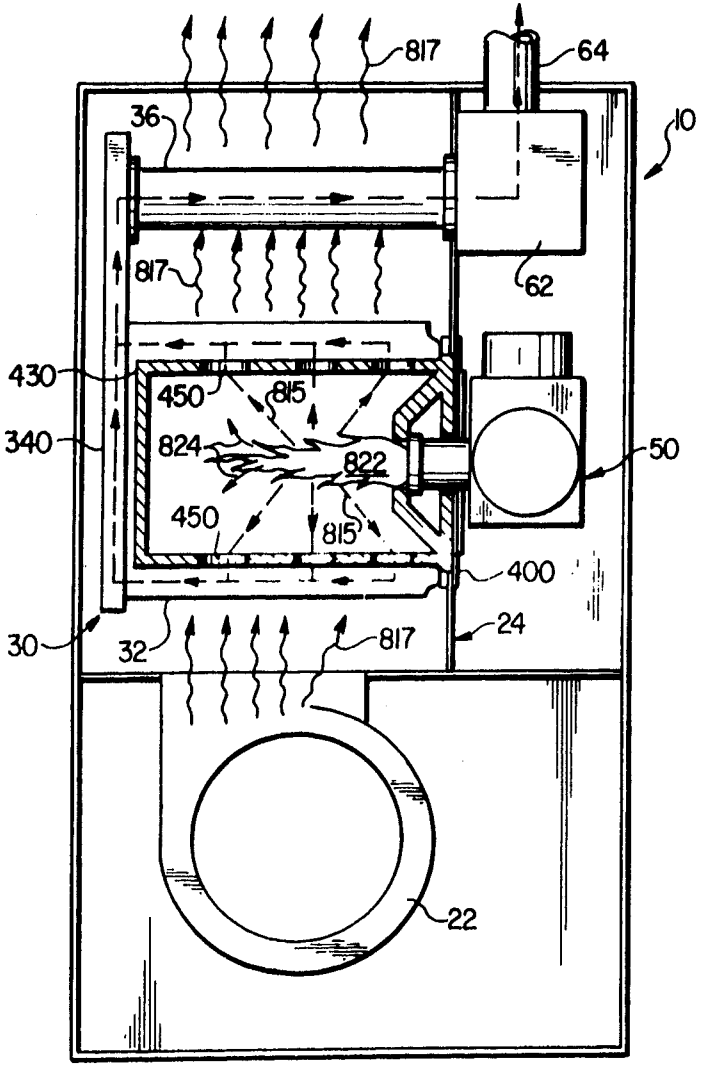
FIG. 1(PRIOR ART)
FIG. 1 is a diagrammatic schematic of a fuel-air furnace illustrating the conventional principles of operation thereof.

Referring first to FIG. 1, there is shown a diagrammatic schematic of a furnace 10, which may be of the forced fuel-air variety. The furnace 10 comprises a recirculating blower 22 in flow communication with a thermal exchange chamber 24, a heat exchanger 30 disposed within the thermal exchange chamber 24, a combustion chamber assembly 400 disposed within and in flow communication with the heat exchanger 30, a fuel-air pump assembly 50 in flow communication with the combustion chamber assembly 400, an exhaust manifold 62 in flow communication with the heat exchanger 30, and an exhaust stack 64 in flow communication with the exhaust manifold 62.

Still referring to FIG. 1, the heat exchanger 30, described in greater detail below, generally comprises a primary heat exchanger body 32 which houses the combustion chamber assembly 400, and a secondary heat exchanger 36. The recirculating blower 22 draws in comfort air 817 from a conditioned space (not shown), and forces the comfort air 817 into the thermal exchange chamber 24. Inside the thermal exchange chamber 24 the comfort air 817 first flows over the primary heat exchanger body 32 then continues to move transversely over the secondary heat exchanger 36. Alternatively, the thermal exchange chamber 24 could be arranged so that the comfort air 817 first flows over the secondary heat exchanger 36, and then continues to flow over the primary heat exchanger 32. The comfort air 817 then exhausts from the thermal exchange chamber 24 into the conditioned space (not shown).

Still referring to FIG. 1, the fuel-air pump assembly 50 maintains a forced fuel-air discharge and the presence of a combustion flame 822 within the combustion chamber assembly 400 during operation thereof. The efficient operation of the furnace 10 depends upon effective burning of fuel and air within the combustion chamber assembly 400 and appropriate thermal distribution of the heat generated therein. For this reason, the combustion chamber assembly 400 is often constructed with a combustion chamber 430 that is cylindrical in shape, having a plurality of combustion chamber apertures 450 formed therethrough. The combustion chamber 430 may be formed of ceramic, or the like, which is known to withstand the intense heat generated by a fuel-air combustion process. The combustion chamber 430 formed of ceramic material permits both radiative and convective distribution of heat within the heat exchanger 30. Heat is thus radiated from the combustion flame 822 as indicated by arrows 815. Hot combustion gasses 824 are also emitted by the combustion flame 822. The hot combustion gasses 824 flow outwardly through the combustion chamber apertures 450, through the primary heat exchanger body 32, and upwardly in a transfer conduit 340 to the secondary heat exchanger 36. The hot combustion gasses 824 are then discharged through the exhaust manifold 62 and the exhaust stack 64. In order for this heat distribution process to occur, however, the combustion chamber apertures 450 in the combustion chamber 430 must be sized and located for proper discharge and circulation of the products of combustion. Due to the intense thermal environment, however, other structural and functional considerations must also be addressed in the design of the combustion chamber 430 and its assembly within the furnace 10. For example, the combustion chamber 430 made of ceramic material will expand and contract in response to the repeated heating and cooling thereof. This thermal cycling may result in certain degeneration of said chamber over time. Eventually a degree of material shrinkage will occur in the combustion chamber 430 due to shrinkage of the ceramic material making up the combustion chamber 430. This shrinkage has been shown to result in cracks, structural mounting problems, and functional inconsistencies.

Referring still to FIG. 1 the construction and operation of a conventional fuel-air type of the furnace 10 is well known in the prior art. For this reason, various parts of the furnace 10 are not described in detail. The fuel-air pump assembly 50, for example is known to introduce fuel through a nozzle in a flame tube wherein it is ignited by a conventional ignition system. This fuel flow is generated concomitantly with a conventional blower providing combustion air to the blast or flame tube. The various conduits, controls, connections, and structural mounting aspects are omitted for the sake of simplicity since the method and apparatus for creating the flame and the furnace operation are conventional.

Figure 2:
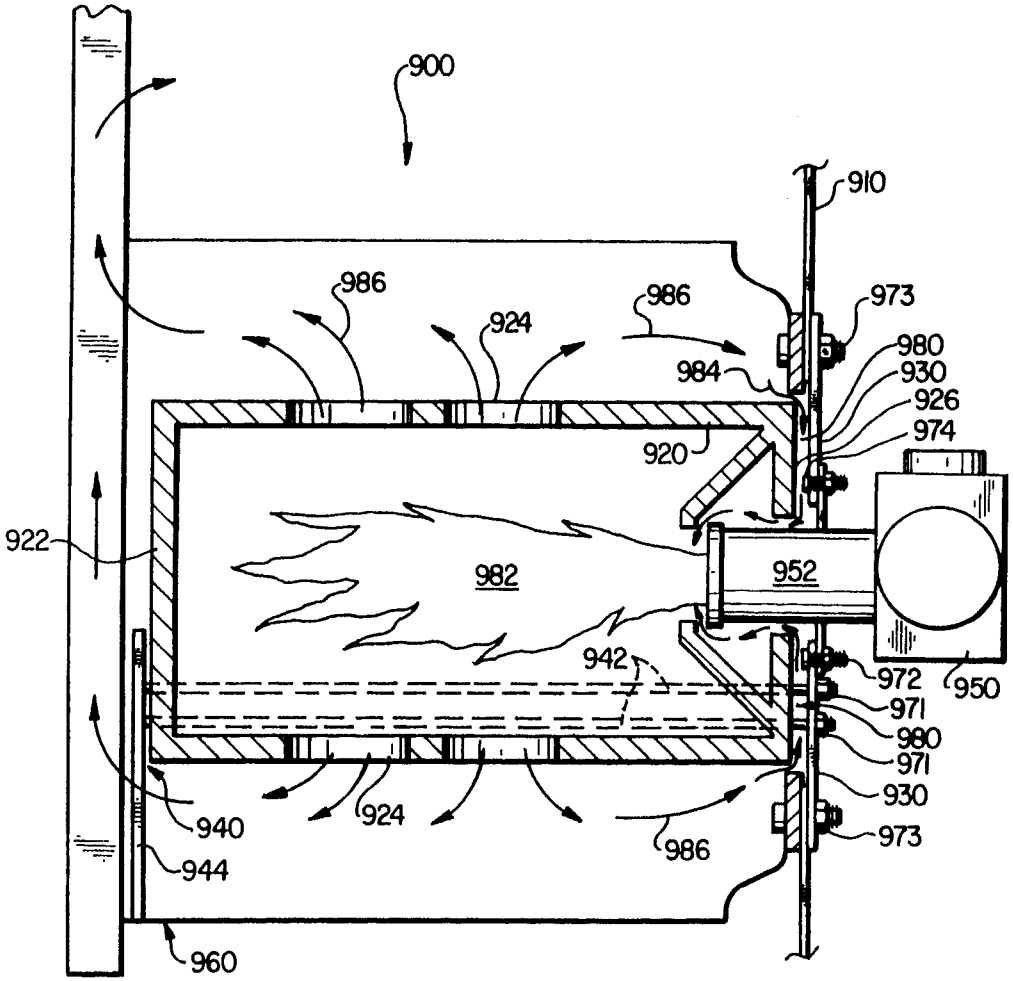
FIG. 2(PRIOR ART)
FIG. 2 is a side-elevational, cross sectional, diagrammatic view of a prior art combustion chamber furnace assembly illustrating various aspects of the operation thereof.

Referring now to FIG. 2 there is shown an enlarged, side elevational view of a prior art furnace 900 illustrating certain structural and functional problems. As shown herein, a combustion chamber 920 (shown in cross section), having a combustion chamber end 922, is mounted to a burner plate 930 by a metal cage 940 which extends from the burner plate 930 to the combustion chamber end 922 and provides structural support for the combustion chamber 920. Cage fasteners 971 are shown securing the metal cage 940 to the burner plate 930, while a plurality of pump assembly fasteners 972 secure a fuel-air pump assembly 950 to the burner plate 930. A plurality of heat exchanger fasteners 973 then fasten a heat exchanger 960 inside a thermal exchange chamber 910, and fasten the burner plate 930 to the thermal exchange chamber 910, thereby disposing the combustion chamber 920 inside the heat exchanger 960.

Referring still to FIG. 2, there are, however, certain issues to be addressed with this design. The metal cage 940 supporting the combustion chamber 920 includes elongated struts 942 (shown by dotted lines) which extend the entire length of the combustion chamber 920 to the combustion chamber end 922. The elongated struts 942 pull against a metal cage end plate 944, which pull against the combustion chamber end 922, which forces the combustion chamber 920 against the burner plate 930. The elongated struts 942 also provide support for the length of the combustion chamber 920. When mounting to the combustion chamber 920 in this manner, subsequent structural problems can manifest themselves. In addition, the venting configuration of the combustion chamber 920 is comprised of a plurality of elongate slots 924 which do not provide the close spacing and flexibility of pattern selection afforded by round apertures. Use of the elongated slots 924 also often results in cracks starting along the edges of the elongated slots 924 from cyclic thermal expansion and contraction. These are problems which have resulted in performance deficiencies in the prior art furnace 900.

As stated above, the elongated struts 942 secure the combustion chamber 920 to the burner plate 930 by pulling the combustion chamber end 922 of the combustion chamber 920 toward the burner plate 930 and the fuel-air pump assembly 950. Shrinkage of the combustion chamber 920 then results in it becoming "loose" within the metal cage 940. It can then eventually move outwardly from the burner plate 930 by virtue of the force generated by a combustion flame 982 injected thereagainst by the fuel-air pump assembly 950. The movement of the combustion chamber 920 away from the burner plate 930 then creates a space 980 between the combustion chamber 920 and the burner plate 930 permitting a gas recirculation path to be established. Gaseous byproducts 986 of the combustion flame 982 are then permitted to recirculate in the direction of arrows 984 around the combustion chamber 920 and back into the combustion flame 982. This flow is caused by a venturi effect generated by the discharge from a prior art fuel-air nozzle 952 of the fuel-air pump assembly 950, adjacent to the space 980 thereby inducing the venturi effect. Generally the effect of this recirculation is to alter the performance of the combustion chamber 920 as originally designed and to create hot spots in and around the combustion chamber 920, the fuel-air pump assembly 950, and portions of the heat exchanger 960. In this "loose" configuration, the combustion chamber 920 is of course mechanically unstable, subject to deleterious vibrational energy and often operationally outside the initial design parameters for maximum efficiency and operation of the prior art furnace 900.

Another aspect of the prior art furnace 900 illustrated in FIG. 2 is the actual mounting of the combustion chamber 920 relative to the burner plate 930. It may be seen that pump assembly fastener heads 974 of the pump assembly fasteners 972 project inwardly from the burner plate 930 against a combustion chamber face 926 of the combustion chamber 920 to therein present an initial space during the time of assembly. This spacing problem is then exacerbated by the above-described shrinkage of the combustion chamber 920.

Figure 3:
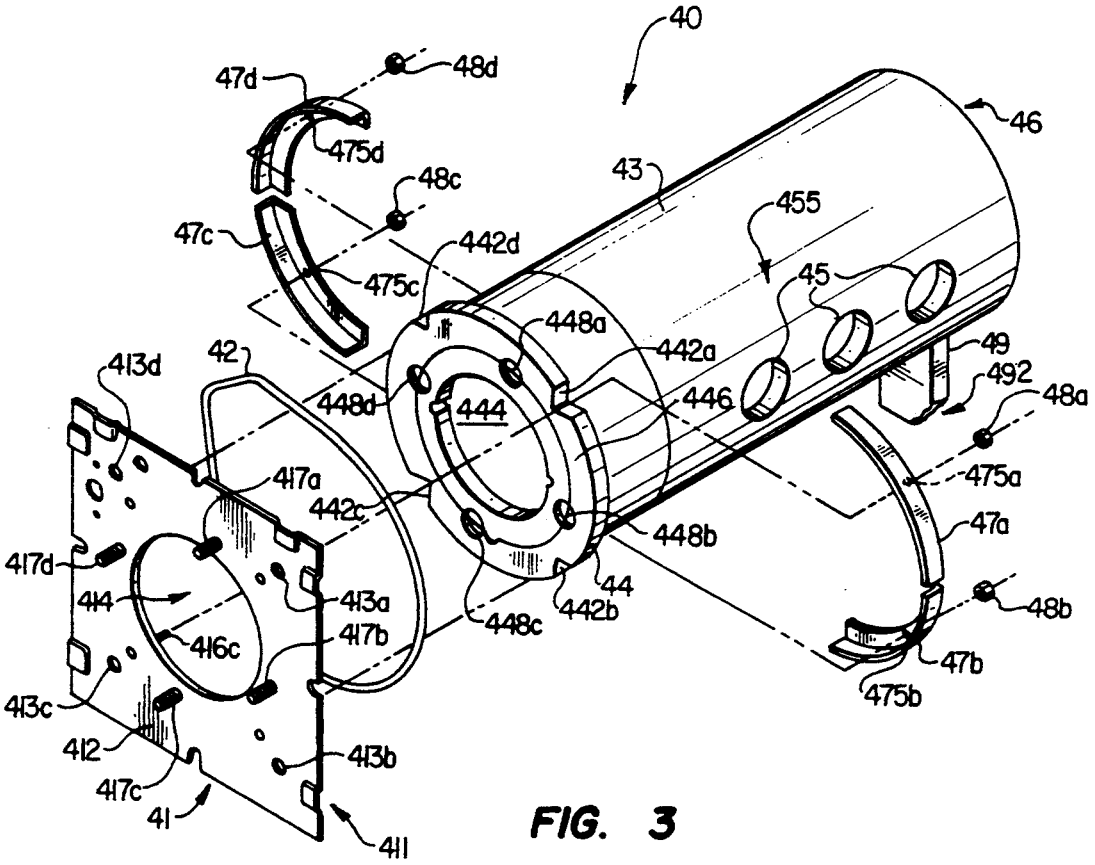
FIG. 3 is an exploded, perspective view of the combustion chamber of the present invention secured to a burner mounting plate in accordance with the principles of the present invention.

Referring now to FIG. 3, therein is shown an exploded perspective view of a combustion chamber assembly 40, constructed in accordance with the principles of the present invention. The combustion chamber assembly 40, described in greater detail below, generally comprises the combustion chamber 43 mounted to a burner mounting plate 41, a support leg 49 mounted to the combustion chamber 43, and a chamber gasket 42 attached to the burner mounting plate 41. The combustion chamber 43 is generally cylindrical in shape with a combustion chamber closed end 46 and a combustion chamber flange 44 on the opposite end from the combustion chamber closed end 46. The combustion chamber flange 44 is formed with four flange notches **442*a*, 442*b*, 442*c*, and 442*d* spaced evenly around the outside of the combustion chamber flange 44, a central throat 444, and a flange mounting face 446 disposed around the outside of the central throat 444. The combustion chamber apertures 45 are formed in the side walls of the combustion chamber 43**.

Referring still to FIG. 3, the burner mounting plate 41 has a mounting plate chamber surface 411 and a mounting plate pump surface 412. Four threaded pump fasteners **417*a*, 417*b*, 417*c*, and 417*d* with pump fastener flat heads 418*a*, 418*b*, 418*c*, and 418*d* respectively (shown in FIG. 4), are mounted in the burner mounting plate 41 so that the threaded pump fasteners 417*a–d* extend out of the mounting plate pump surface 412 and the pump fastener flat heads 418*a–d* (shown in FIG. 4) are disposed on the mounting plate chamber surface 411. The threaded pump fasteners 417*a–d* are located on the burner mounting plate 41 so that the fuel-air pump assembly 50 (from FIG. 1) can be located in a pump aperture 414 in the burner mounting plate 41. Disposed around the outer portions of the burner mounting plate 41 are four mounting plate apertures 413*a*, 413*b*, 413*c*, and 413*d* for mounting the burner mounting plate 41 to the thermal exchange chamber 24 (see FIG. 1). The chamber gasket 42 is placed on the mounting plate chamber surface 411 of the burner mounting plate 41 and inside the mounting plate apertures 413*a–d* for a sealing engagement with the thermal exchange chamber 24** (shown in FIG.4).

Still referring to FIG. 3, the flange mounting face 446 of the combustion chamber 43 and the mounting plate chamber surface 411 of the burner mounting plate 41 are constructed for direct mounting to each other, the pump aperture 414 of the burner mounting plate 41 being in registry with the central throat 444 of the combustion chamber 43. The combustion chamber flange 44 has four circular flange recesses **448*a*, 448*b*, 448*c*, and 448*d* in registry with, and for clearance with, the pump fastener flat heads 418*a–d* (shown in FIG. 4) of the threaded pump fasteners 417*a–d* on the burner mounting plate 41. The burner mounting plate 41 also has four threaded chamber fasteners 416*a*, 416*b*, 416*c*, and 416*d* mounted on the mounting plate chamber surface 411 and in registry with the flange notches 442*a–d* respectively, in the combustion chamber flange 44. Four retainer ring sections 47*a*, 47*b*, 47*c*, and 47*d* are formed for registry with the combustion chamber flange 44 in a collar fashion, and have retainer ring apertures 475***a*, 475*b*, 475*c*, and 475*d* which the threaded chamber fasteners 416*a–d* extend through. Four retainer ring threaded nuts 48*a*, 48*b*, 48*c*, and 48*d* engage the threaded chamber fasteners 416*a–d* forcing the retainer ring sections 47*a–d* against the combustion chamber flange 44, thereby securing the combustion chamber 43 to the burner mounting plate 41. In this manner, the flange mounting face 446 can be mounted directly against the mounting plate chamber surface 411 with the central throat 444 in axial alignment/registry with the fuel-air pump assembly 50 (which will be shown in FIG. 4) without the utilization of a separate support cage of the type described above in the prior art.

Still referring to FIG. 3, it can be seen that any shrinkage of the combustion chamber 43 will have minimal effect, if any, upon the securement of said chamber to the burner mounting plate 41 and its placement around said fuel-air nozzle. In the prior art furnace 900 of FIG. 2, the metal cage 940 supports the combustion chamber 920 across the entire length of the combustion chamber 920 allowing greater possibility of movement of the combustion chamber 920 relative to the metal cage 940 due to shrinkage across the entire length of the combustion chamber 920. In the present invention, only the shrinkage of the combustion chamber flange 44 under the retainer ring sections 47*a–d* affects the mounting of the combustion chamber 43. Since the combustion chamber flange 44 may be on the order of less than 5% of the overall length of the chamber itself, there is thus at least a 20 fold decrease in the deleterious effect of chamber shrinkage as compared to the prior art support cages described above. In addition, the manner of fastening of the combustion chamber 43 to the burner mounting plate 41 affords more structural rigidity and mechanical integrity once the furnace 10 is installed than with prior art embodiments. The present assembly thus facilitates improved operations and maintenance of the combustion chamber 43.

Still referring to FIG. 3, therein is shown a variation in the pattern of the combustion chamber apertures 45 as compared to the prior art configuration of apertures seen in FIG. 2. The combustion chamber apertures 45 formed in the combustion chamber 43 are circular in shape and are disposed in a discrete chamber aperture pattern 455 that is designed to maximize thermal distribution efficiency. The circular shape of the combustion chamber apertures 45 permit a closer spacing between adjacent holes and less likelihood of thermal cracking as compared to certain prior art slotted configurations. The discrete chamber aperture pattern 455 may also be varied for particular combustion chamber installations. In the present embodiment, the discrete chamber aperture pattern 455 is deployed across a semi cylindrical portion of the combustion chamber 43.

Referring still to FIG. 3, there is shown the support leg 49 secured to, and extending from, the combustion chamber closed end 46. The support leg 49 of the present invention is constructed of a combustible material, such as cardboard, wood, or the like, providing end support to the combustion chamber 43 during periods of assembly, handling, and shipment. As shown, the support leg 49 is formed of folded cardboard with a leg cut away 492 shown for illustrating one fold configuration. Since the combustion chamber 43 is supported entirely about the combustion chamber flange 44, the support leg 49 affixed to the combustion chamber closed end 46 by glue, or the like, provides underlying support of said end during periods of shipping and handling when dynamic loading on the chamber can greatly exceed the loading during operation once the furnace 10 has been installed. As such the support leg 49 affords the advantage of temporary structural support when it is needed and automatic disintegration once it is no longer necessary. The disintegration of the support leg 49 is designed to occur during the normal combustion operation. Optimally, the support leg 49 will not disintegrate during a short duration production test, but disintegrate during a normal ignition burn cycle following installation. Combustion legs of the prior art variety are permanent in design, generally being made of ceramic or metal to withstand the heat of combustion. However, in order to cause flow patterns around the combustion chamber 43 for maximum efficiency, it is often desirous not to have the permanent legs of the prior art furnaces which could alter these flow patterns. Therefore, the support leg 49 allows for support of the combustion chamber 43 when needed prior to installation, but, disintegrates during normal operation in order to allow flow patterns requiring the absence of the support leg 49.

Figure 4:
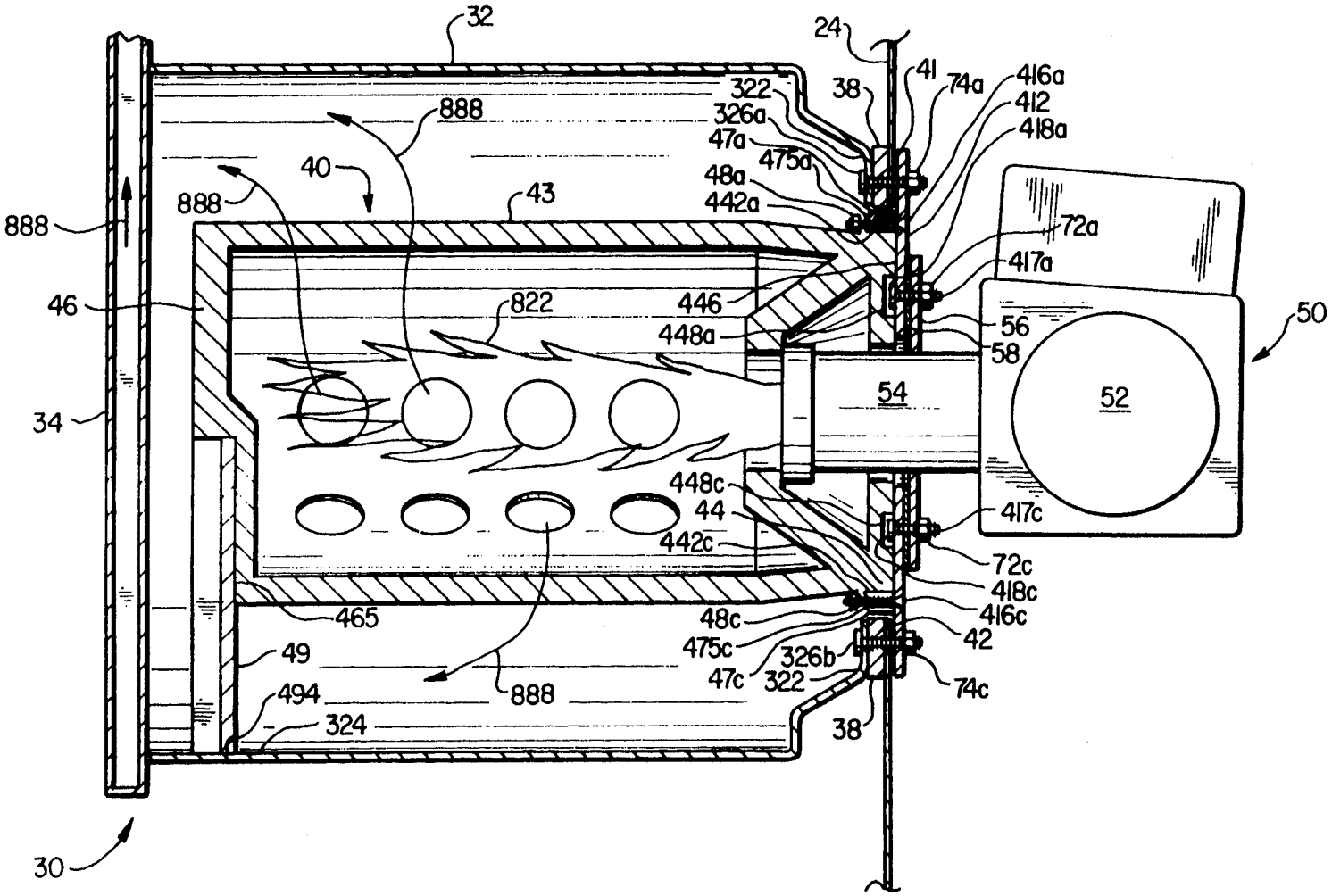
FIG. 4 is a side-elevational, cross sectional view of the combustion chamber of FIG. 3 assembled within a furnace heat exchanger and illustrating the principles of operation thereof.

Referring now to FIG. 4 there is shown a side elevational cross-sectional view of the thermal exchange chamber 24, the primary heat exchanger body 32 of the heat exchanger 30, the combustion chamber assembly 40, and the fuel-air pump assembly 50 of FIG. 3, illustrating in further detail the mounting configuration of these components. As described above, the threaded chamber fasteners 416*a–d* extend through the flange notches 442*a–d* formed in the combustion chamber flange 44. The retainer ring sections 47*a–d* are disposed in a collar fashion about the combustion chamber flange 44, with the threaded chamber fasteners 416*a–d* extending through the retainer ring apertures 475*a–d* therein. The retainer ring threaded nuts 48*a–d* engage the threaded chamber fasteners 416*a–d* for securing the retainer ring sections 47*a–d* tightly against the combustion chamber flange 44 thereby securing the combustion chamber 43 to the burner mounting plate 41.

Still referring to FIG. 4, the burner mounting plate 41 is then shown to be secured to the thermal exchange chamber 24 by four threaded furnace fasteners 326*a*, 326*b*, 326*c*, and 326*d*, and four furnace fastener threaded nuts 74*a*, 74*b*, 74*c*, and 74*d*, which also secure a curved end wall 322 of the primary heat exchanger body 32. The chamber gasket 42 is positioned between the burner mounting plate 41 and the thermal exchange chamber 24, and, a high temperature insulating gasket 38 is positioned between the thermal exchange chamber 24 and the curved end wall 322. As will be described in more detail below, this particular mounting assembly promotes structural rigidity and efficiency in operation by eliminating the effects of thermal expansion, contraction and shrinkage of the combustion chamber 43.

Still referring to FIG. 4, the fuel-air pump assembly 50 consists of a fuel-air pump 52 in flow communication with a fuel-air nozzle 54, and a pump mounting plate 56 attached to the fuel-air nozzle 54. The pump mounting plate 56 is positioned against the mounting plate pump surface 412 of the burner mounting plate 41 with a burner gasket 58 sandwiched therebetween. The threaded pump fasteners 417*a–d* of the burner mounting plate 41 extend through the burner gasket 58 and the pump mounting plate 56. Four pump fastener threaded nuts 72*a*, 72*b*, 72*c*, and 72*d* are then utilized to engage the threaded pump fasteners 417*a–d* and secure the pump mounting plate 56 to the burner mounting plate 41. The circular flange recesses 448*a–d* are provided in the flange mounting face 446 adapted for receipt of the pump fastener flat heads 418*a–d* therein when placed in registry therewith. The fuel-air nozzle 54 is then positioned in axial alignment with the combustion chamber 43 for discharging the combustion flame 822 into the combustion chamber 43.

Referring still to FIG. 4, at the combustion chamber closed end 46, the support leg 49 is shown disposed in a combustion chamber leg recess 465. The cross section illustrates one particular folded cardboard configuration of the support leg 49. Other configurations and materials may be used in accordance with the present invention. A support leg bottom 494 of the support leg 49 is permitted to rest upon a bottom wall 324 of the primary heat exchanger body 32 to thereby provide interim mechanical support for the combustion chamber 43 during shipping and handling. Also, as shown in this configuration, the primary heat exchanger body 32 further includes the transfer conduit 34 permitting passage of combustion gases upwardly in the direction of an arrow 888 toward the secondary heat exchanger 36 (see FIG. 1).

Figure 5:
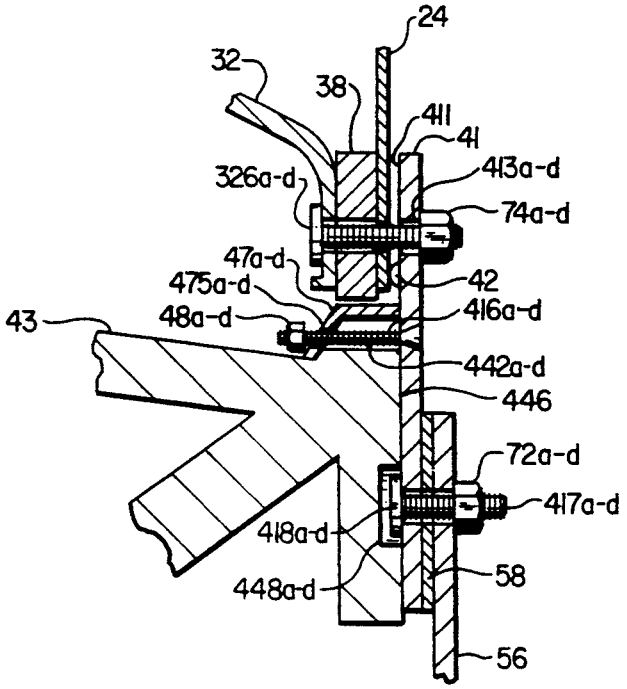
FIG. 5 is an enlarged, fragmentary view of a portion of the assembly of the combustion chamber and burner mounting plate of FIG. 4.

Referring now to FIG. 5 there is shown an enlarged side elevational cross sectional view of a portion of the assembly of the combustion chamber 43 and the burner mounting plate 41 of FIG. 4 illustrating the particular mounting relationship therebetween. As shown, the high temperature insulating gasket 38 is disposed between the primary heat exchanger body 32 and the thermal exchange chamber 24. The chamber gasket 42 of the burner mounting plate 41, preferably a fiberglass rope type gasket, is disposed inwardly of the mounting plate apertures 413*a–d*. The threaded furnace fasteners 326*a–d* extend through the high temperature insulating gasket 38, the thermal exchange chamber 24, and the mounting plate apertures 413*a–d* of the burner mounting plate 41. The furnace fastener threaded nuts 74*a–d* engage the threaded furnace fasteners 326*a–d*. As the furnace fastener threaded nuts 74*a–d* are tightened, the chamber gasket 42 is squeezed between the burner mounting plate 41 and the thermal exchange chamber 24, and the high temperature insulating gasket 38 is squeezed between the primary heat exchanger body 32 and the thermal exchange chamber 24. This squeezing effect causes the chamber gasket 42 and the high temperature insulating gasket 38 to create a barrier against discharge of combustion products between the burner mounting plate 41 and the thermal exchange chamber 24, and between the primary heat exchanger body 32 and the thermal exchange chamber 24, respectively.

Referring still to FIG. 5, a more clear illustration is likewise seen of the threaded chamber fasteners 416*a–d*, comprising a stud extending from the mounting plate chamber surface 411 of the burner mounting plate 41, through the flange notches 442*a–d* of the combustion chamber 43, and emerging through the retainer ring apertures 475*a–d* of the retainer ring sections 47*a–d*. The retainer ring threaded nuts 48*a–d* engage the threaded chamber fasteners 416*a–d*, forcing the retainer ring sections 47*a–d* against the combustion chamber flange 44, thereby sealing the flange mounting face 446 of the combustion chamber 43 with the mounting plate chamber surface 411 of the burner mounting plate 41.

Still referring to FIG. 5, the burner gasket 58 is shown sandwiched between the pump mounting plate 56 and the burner mounting plate 41, which are held together by the threaded pump fasteners 417*a–d* and the pump fastener threaded nuts 72*a–d*. The position of the flange mounting face 446 of the combustion chamber 43 is shown to be disposed flushly against the mounting plate chamber surface 411 in accordance with the principles of the present invention. The pump fastener flat heads 418*a–d* of the threaded pump fasteners 417*a–d*, discussed above, are likewise shown adequately recessed within the circular flange recesses 448*a–d* formed in the flange mounting face 446 of the combustion chamber 43. In this configuration it may be seen that there is no path for recirculation of the byproducts of combustion. In addition, adequate thermal insulation has been provided to provide an assembly that is structurally sound and functionally reliable. Furthermore, the assembly lends itself to repair operations by permitting removal of the combustion chamber 43 and the burner mounting plate 41 from the thermal exchange chamber 24 by removal of the furnace fastener threaded nuts 74*a–d*. In essence, the burner mounting plate 41 functions not only as a support for the combustion chamber 43 but as an integral element of the heat exchanger 30 (shown in FIG. 4) and by removing the burner mounting plate 41, access to the primary heat exchanger body 32 for repair and cleaning is greatly facilitated.

It is thus believed that the operation and construction of the present invention will be apparent from the foregoing description. While the method and apparatus shown or described as being characterized as being preferred, it will be obvious that various changes and modifications may be made therein without departing from the spirit and scope of the invention as defined in the following claims.

What is claimed is:

1. An improved fuel-air combustion furnace of the type wherein a combustion chamber that is disposed in flow communication with a fuel-air nozzle is secured to a burner mounting plate and assembled to a heat exchanger for transfer of the heat generated in the combustion chamber to circulation air flowing over said heat exchanger within said furnace, wherein the improvement comprises:

said combustion chamber comprising an outer wall and an annular flange, the flange having a first side adapted for flush mounting against said burner mounting plate and a second side extending nonperpendicularly from the outer wall;

mounting means adapted for engaging said flange of said combustion chamber in a mating relationship therewith for structural securement thereof; and attachment means in association with said mounting means for securing said combustion chamber flange to said burner mounting plate with said combustion chamber flushly mounted thereagainst in flow communication with said fuel-air nozzle.

2. The apparatus as set forth in claim 1 wherein said combustion chamber has a generally cylindrical outer surface.

3. The apparatus as set forth in claim 2 wherein said combustion chamber is formed with a plurality of circular apertures in a select pattern along said cylindrical surface.

4. The apparatus as set forth in claim 1 wherein said combustion chamber is cylindrical in shape and is formed with an array of circular apertures disposed in a first semi-cylindrical region thereof.

5. The apparatus as set forth in claim 1 wherein said mounting means comprises an attachment collar having a generally arcuate longitudinal formation adapted for mating engagement with said combustion chamber flange.

6. The apparatus as set forth in claim 5 wherein said mounting means further includes threaded elements extending from said burner mounting plate through portions of said flange of said combustion chamber and through said collar for the securement thereof to said burner mounting plate.

7. The apparatus as set forth in claim 1 wherein said mounting means comprises a plurality of retainer ring sections having a generally arcuate longitudinal formation adapted for mating engagement with said combustion chamber flange.

8. The apparatus as set forth in claim 7 wherein said plurality of retainer ring sections comprises four retainer ring sections.

9. The apparatus as set forth in claim 7 wherein said mounting means further includes threaded elements extending from said burner mounting plate through portions of said flange said combustion chamber and through said retainer ring sections for the securement thereof to said burner mounting plate.

10. The apparatus as set forth in claim 1 wherein said combustion chamber includes at least one assembly support leg extending from an end thereof opposite said combustion chamber flange.

11. The apparatus as set forth in claim 10 wherein said support leg is formed of combustible material adapted to disintegrate during operation of said combustion chamber.

12. The apparatus as set forth in claim 11 wherein said support leg comprises folded cardboard and depends from said combustion chamber a sufficient distance to rest upon a surface of said heat exchanger disposed therebeneath providing support thereof.

13. An improved fuel-air combustion furnace of the type wherein a combustion chamber is secured in flow communication with a fuel-air nozzle, assembled to a burner mounting plate, and mounted to a heat exchanger disposed within said furnace, wherein the improvement comprises means for mounting a first end of said combustion chamber to said burner mounting plate with a second, opposite end of said combustion chamber supported by a combustible leg depending therefrom and adapted for disintegration during operation of said combustion chamber.

14. The apparatus as set forth in claim 13 wherein said support leg is formed of cardboard.

15. The apparatus as set forth in claim 13 and further including:

said combustion chamber being formed with a flange;

mounting means adapted for engaging said flange of said combustion chamber in a mating relationship therewith; and attachment means in association with said mounting means for securing said combustion chamber flange to said burner mounting plate with said combustion chamber flushly mounted thereagainst in flow communication with said fuel-air nozzle.

16. The apparatus as set forth in claim 15 wherein said combustion chamber has a generally cylindrical outer surface.

17. The apparatus as set forth in claim 16 wherein said combustion chamber is formed with a plurality of circular apertures in a select pattern along said cylindrical surface.

18. The apparatus as set forth in claim 17 wherein said array of circular apertures is disposed in a first semi-cylindrical region thereof.

19. The apparatus as set forth in claim 15 wherein said mounting means comprises an attachment collar, split into a plurality of retainer ring sections to facilitate assembly to said flange of said combustion chamber.

20. The apparatus as set forth in claim 19 wherein said attachment collar is split into four retainer ring sections.

21. The apparatus as set forth in claim 19 wherein said attachment collar is formed with a generally L-shaped cross section and a generally arcuate longitudinal shape adapted for mating engagement with said combustion chamber flange.

22. The apparatus as set forth in claim 21 wherein said attachment means further includes threaded elements extending from said burner mounting plate, through portions of said flange of said combustion chamber and through said collar for the securement thereof to said burner mounting plate.

23. A method of mounting a combustion chamber in a fuel-air combustion furnace of the type wherein said combustion chamber is secured to a burner mounting plate and disposed within a heat exchanger of a furnace housing for thereby containing a combustion flame discharged therein, said method comprising the steps of:

forming said combustion chamber with an outer wall and an annular flange, said flange having a first side adapted for flush mounting against said burner plate and a second side extending non-perpendicularly from said outer wall;

providing mounting means adapted for engaging said flange of said combustion chamber;

securing said mounting means about said flange of said combustion chamber;

securing said mounting means and said flange of said combustion chamber against said burner mounting plate; and securing said burner mounting plate to said furnace housing.

24. The method as set forth in claim 23 and further including the steps of:

forming said combustion chamber with a plurality of openings in the area of said combustion chamber flange;

forming said mounting means with apertures adapted for alignment with said openings of said combustion chamber flange;

providing a plurality of threaded fasteners for extending through said openings of said mounting means and said flange of said combustion chamber; and securing said mounting means and said combustion chamber flange to said burner mounting plate with said threaded fasteners.

25. The method as set forth in claim 23 and further including the steps of fabricating a combustion chamber support leg from combustible material and attaching said support leg to said combustion chamber for the support thereof within said furnace and the disintegration thereof upon operation ignition of said combustion chamber.

26. The method as set forth in claim 23 and further including the step of fabricating said combustion chamber with a plurality of circular venting apertures for permitting the egress of products of combustion therethrough.

27. The method as set forth in claim 23 and including the step of forming said mounting means in the shape of a metal collar having a generally L-shaped cross section and a generally arcuate longitudinal shape adapted for mating engagement with said combustion chamber flange.

28. The method as set forth in claim 23 and including the step of forming said mounting means in the form of a plurality of retainer ring sections having a generally L-shaped cross section and a generally arcuate longitudinal shape adapted for mating engagement with said combustion chamber flange.

29. The method as set forth in claim 23 and including the step of forming said mounting means in the form of four retainer ring sections having a generally L-shaped cross section and a generally arcuate longitudinal shape adapted for mating engagement with said combustion chamber flange.

30. The apparatus as set forth in claim 1, wherein said combustion chamber is substantially comprised of ceramic material.

31. The apparatus as set forth in claim 5, wherein said attachment collar is sectional.

32. The apparatus as set forth in claim 5, wherein the attachment collar has a generally L-shaped cross section.

33. The apparatus as set forth in claim 7, wherein at least one retainer ring section has a generally L-shaped cross section.

34. The apparatus as set forth in claim 13, wherein said combustion chamber is substantially comprised of ceramic material.

35. The apparatus as set forth in claim 19, wherein said attachment collar is metal.

36. An improved fuel-air combustion furnace of the type wherein a combustion chamber that is disposed in flow communication with a fuel-air nozzle is secured to a burner mounting plate and assembled to a heat exchanger for transfer of the heat generated in the combustion chamber to circulation air flowing over said heat exchanger within said furnace, wherein the improvement comprises:

said combustion chamber being formed with a flange adapted for flush mounting against said burner mounting plate;

mounting means, including an attachment collar having a generally arcuate longitudinal formation, adapted for engaging said flange of said combustion chamber in a mating relationship therewith for structural securement thereof; and attachment means in association with said mounting means for securing said combustion chamber flange to said burner mounting plate with said combustion chamber flush mounted thereagainst in flow communication with said fuel-air nozzle.

37. The improved fuel-air combustion furnace of claim 36, wherein said attachment collar has a generally L-shaped cross section.

38. An improved fuel-air combustion furnace of the type wherein a combustion chamber that is disposed in flow communication with a fuel-air nozzle is secured to a burner mounting plate and assembled to a heat exchanger for transfer of the heat generated in the combustion chamber to circulation air flowing over said heat exchanger within said furnace, wherein the improvement comprises:

said combustion chamber being formed with a flange adapted for flush mounting against said burner mounting plate;

mounting means, including a plurality of retainer ring sections having a generally arcuate longitudinal formation, adapted for engaging said flange of said combustion chamber in a mating relationship therewith for structural securement thereof; and attachment means in association with said mounting means for securing said combustion chamber flange to said burner mounting plate with said combustion chamber flush mounted thereagainst in flow communication with said fuel-air nozzle.

39. The improved fuel-air combustion furnace of claim 38, wherein at least one of said retainer rings has a generally L-shaped cross section.

40. A method of mounting a combustion chamber in a fuel-air combustion furnace of the type wherein said combustion chamber is secured to a burner mounting plate and disposed within a heat exchanger of a furnace housing for thereby containing a combustion flame discharged therein, said method comprising the steps of:

forming said combustion chamber with a flange adapted for flush mounting against said burner plate;

attaching to said combustion chamber a combustible support leg for supporting said combustion chamber during said mounting method and for disintegrating upon operation ignition of said combustion chamber;

providing mounting means adapted for engaging said flange of said combustion chamber;

securing said mounting means about said flange of said combustion chamber;

securing said mounting means and said flange of said combustion chamber against said burner mounting plate; and securing said burner mounting plate to said furnace housing.

41. A fuel-air combustion furnace comprising:

a combustion chamber;

an annular flange at a first end of said chamber;

a burner mounting plate; and a means for flush mounting said first end of said combustion chamber to said burner mounting plate, said flush mounting means comprising at least one retainer ring section adapted for mating engagement with said annular flange.

42. The fuel-air combustion furnace of claim 41, further comprising a combustible support means, attached to said combustion chamber, for supporting said combustion chamber during installation thereof and for decomposing during operation of said combustion chamber.

43. The fuel-air combustion furnace of claim 41, wherein said combustion chamber is substantially ceramic.

* * * * *

UNITED STATES PATENT AND TRADEMARK OFFICE

CERTIFICATE OF CORRECTION

PATENT NO. : 5,368,011

DATED : November 29, 1994

INVENTOR(S) : Timothy J. Bodner

It is certified that error appears in the above-indentified patent and that said Letters Patent is hereby corrected as shown below:

Column 13, Line 23: After "flange"; insert --of--.

Signed and Sealed this

Twenty-third Day of May, 1995

*Attest:*

Bruce Lehman

BRUCE LEHMAN

*Attesting Officer*

*Commissioner of Patents and Trademarks*